US008514542B2

(12) United States Patent
Kuo

(10) Patent No.: US 8,514,542 B2
(45) Date of Patent: Aug. 20, 2013

(54) RELAY DRIVE CIRCUIT

(75) Inventor: Heng-Chen Kuo, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 446 days.

(21) Appl. No.: 12/894,158

(22) Filed: Sep. 30, 2010

(65) Prior Publication Data

US 2011/0299212 A1 Dec. 8, 2011

(30) Foreign Application Priority Data

Jun. 4, 2010 (TW) ..... 99118045 A

(51) Int. Cl.
*H01H 47/00* (2006.01)

(52) U.S. Cl.
USPC ..... 361/160

(58) Field of Classification Search
USPC ..... 361/160
See application file for complete search history.

(56) References Cited

U.S. PATENT DOCUMENTS 6,233,132 B1 * 5/2001 Jenski ..... 361/160

* cited by examiner

*Primary Examiner* — Stephen W Jackson
(74) *Attorney, Agent, or Firm* — Altis Law Group, Inc.

(57) ABSTRACT

A relay drive circuit electrically connects to an alternating current power source for driving a relay includes a zero crossing test circuit, a logic control circuit, and a switch. The zero crossing test circuit is electrically connected to the alternating current power source and is for obtaining zero crossing regions of the alternating current power source and outputting a corresponding zero crossing detect signal. The logic control circuit is electrically connected to the zero crossing circuit and is capable of receiving the zero crossing detect signal and a corresponding switch control signal. The switch is electrically connected to the logic control circuit and the relay and is switched on or off in the zero crossing regions under the control of an output signal from the logic control circuit to corresponding control and power the relay on or off.

18 Claims, 4 Drawing Sheets

RELAY DRIVE CIRCUIT

BACKGROUND

1. Technical Field

The disclosure generally relates to drive circuits, and more particularly relates to a relay drive circuit for driving a relay.

2. Description of the Related Art

Electromagnetic relays are often used in various types of power supply systems, such as uninterruptable power supply (UPS) systems and power distribution unit (PDU) systems, and generally, the relays operate on alternating current (AC) from a high-voltage source. Such relays usually include drive coils and metal elastic sheets, so when the drive coils are powered on/off, the metal elastic sheets are connected or disconnected to and from each other accordingly.

However, when the relays are in a working state, the AC flows through the drive coils, resulting in an inductance effect, which can delay the relay turning on/off, and the metal elastic sheets may generate electrical arcing when initially contacting or disconnecting with each other. Moreover, the electromagnetic relay may output an unstable voltage when the metal elastic sheets contact with each other.

Therefore, there is room for improvement within the art.

BRIEF DESCRIPTION OF THE DRAWINGS

Many aspects of an exemplary relay drive circuit can be better understood with reference to the following drawings. The components in the drawings are not necessarily drawn to scale, the emphasis instead being placed upon clearly illustrating the principles of the exemplary relay drive circuit. Moreover, in the drawings, like reference numerals designate corresponding parts throughout the several views. Wherever possible, the same reference numbers are used throughout the drawings to refer to the same or like elements of an embodiment.

DETAILED DESCRIPTION

Figure 1:
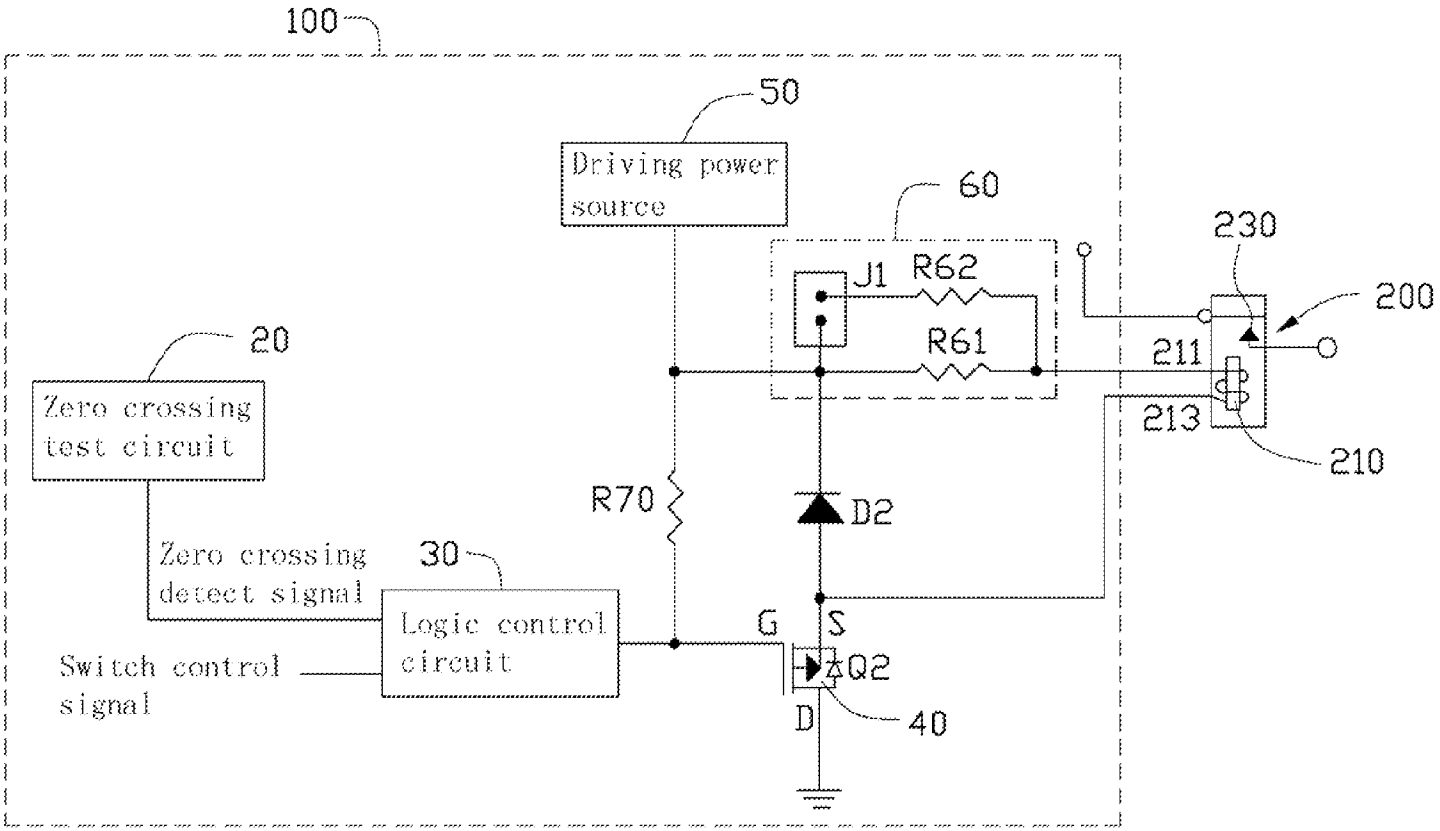
FIG. 1 is a circuit view of a relay drive circuit driving a relay, according to an exemplary embodiment.
Figure 2:
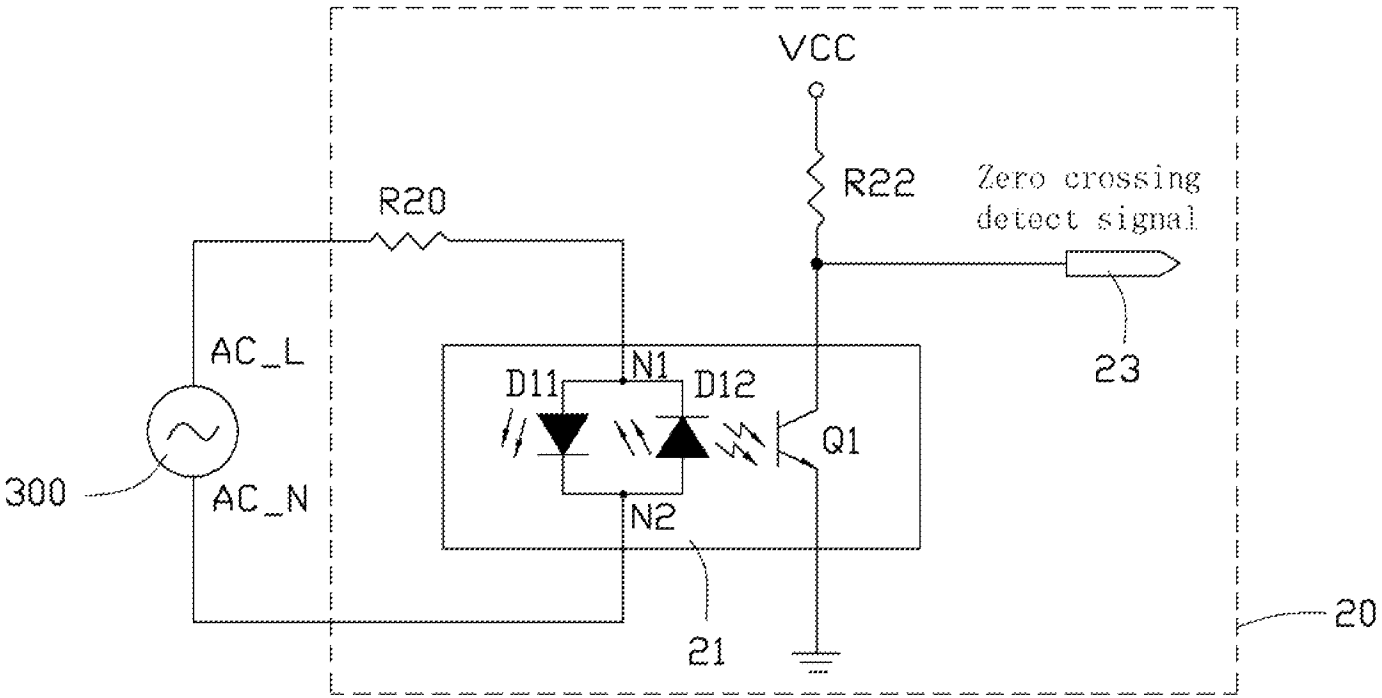
FIG. 2 is a circuit view of one embodiment of an zero crossing test circuit of the relay drive circuit as shown in FIG. 1.

FIGS. 1-2 show an exemplary embodiment of a relay drive circuit 100, which is applied in a power supply system including an alternating current (AC) power source 300 to drive a relay 200. The relay drive circuit 100 includes a zero crossing test circuit 20, a logic control circuit 30, a switch 40, a driving power source 50, and a regulating circuit 60.

In this exemplary embodiment, the relay 200 can be an electromagnetic relay and includes a coil 210 and a metal contact 230. The coil 210 includes a first end 211 and a second end 213. When the AC flows through the coil 210, the coil 210 generates a corresponding magnetic field causing the metal contact 230 to be connected to different function circuits by the magnetic field. Otherwise when the AC does not flow through the coil 210, a corresponding magnetic field is not generated, therefore the metal contact 230 is disconnected from the corresponding function circuits. In practice, the zero crossing test circuit 20 obtains different zero crossing points of the AC power source 300 to further obtain corresponding zero crossing regions. Thus, the relay 200 can be stably switched in the zero crossing regions.

Also referring to FIG. 2, the zero crossing test circuit 20 is capable of detecting the intersection of the contiguous forward voltage and reverse voltage output by the AC power source 300 to obtain the zero crossing points and the zero crossing regions. The zero crossing test circuit 20 includes an optocoupler 21, a current limiting resistance R20, a first pull-up resistor R22, and an output port 23. The optocoupler 21 can be an AC optocoupler and includes two parallel light emitting diodes (LEDs) D11 and D12, and a phototransistor Q1. One end of the AC power source 300 is electrically connected between the anode of the LED D11 and the cathode of the LED D12 through the current limiting resistance R20 forming a node N1, and another end of the AC power source 300 is electrically connected between the cathode of the LED D11 and the anode of the LED D12 forming another node N2.

The phototransistor Q1 can be a npn transistor, having an emitter electrically connected to ground, and a collector electrically connected to a power source VCC through the first pull-up resistor R22. The output port 23 is electrically connected between the collector of the phototransistor Q1 and the first pull-up resistor R22 to transmit a zero crossing detect signal to the logic control circuit 30. Adjusting the resistance of the current limiting resistance R20, the width of the zero crossing region is adjusted accordingly.

Thus, when the voltage (either the forward voltage or the reverse voltage) of the AC power source 300 is higher than the sum of the voltage of the current limiting resistance R20 and the voltage between the nodes N1 and N2, the LED D11 or the LED D12 then is powered on and lights up. Thus, the phototransistor Q1 is turned on, and the output port 23 outputs a corresponding low zero crossing detect signal. Similarly, when the voltage of AC power source 300 is in the zero crossing regions and is lower than the sum of the voltage of the current limiting resistance R20 and the voltage between the nodes N1 and N2, neither LED D11 nor the LED D12 is turned on and lights up. Thus, the phototransistor Q1 is turned off, and the output port 23 outputs a corresponding high zero crossing detect signal to the logic control circuit 30.

Further referring to FIG. 1, the logic control circuit 30 is electrically connected to the output port 23 and receives the zero crossing detect signal from the output port 23 and a corresponding switch control signal to control the switch 40. Thus, when the zero crossing detect signal is high, the output signal from the logic control circuit 30 maintains the same phase as the switch control signal and is controlled by the switch control signal. When the zero crossing detect signal is low, the switch control signal is inactivated, and the output signal from the logic control circuit 30 is not controlled by the switch control signal and its phase is unchanged. Thus, when the zero crossing detect signal is high, that is, the AC power source 300 is in the zero crossing regions, the switch control signal is enabled and activated to control the relay 200 to switch on/off.

In this exemplary embodiment, the switch 40 can be a p-channel metal-oxide semiconductor field effect transistor (MOSFET) Q2. A drain of the MOSFET Q2 is electrically connected to ground, its gate is electrically connected to the logic control circuit 30, and a source of the MOSFET Q2 is electrically connected to the second end 213 and the anode of a diode D2 electrically connected to the regulating circuit 60. A gate of the MOSFET Q2 is further electrically connected to the power source 50 through a second pull-up resistor R70. Moreover, the switch 40 can instead be a pnp transistor, whose base, emitter and collector correspond to the gate, the source, and the drain of the MOSFET Q2, respectively.

The regulating circuit 60 includes a first divider resistance R61, a second divider resistance R62, and a jumper J1. An end of the second divider resistance R62 is electrically connected to the first end 211 of the coil 210, and another end is electrically connected to an end of the jumper J1. An end of the first divider resistance R61 is electrically connected to the first end 211, and another end is electrically connected to another end of the jumper J1, the cathode of the diode D2 and is electrically connected between the drive power source 50 and the second pull-up resistor R70. The drive power source 50 provides a driving voltage for the relay 200.

Figure 3:
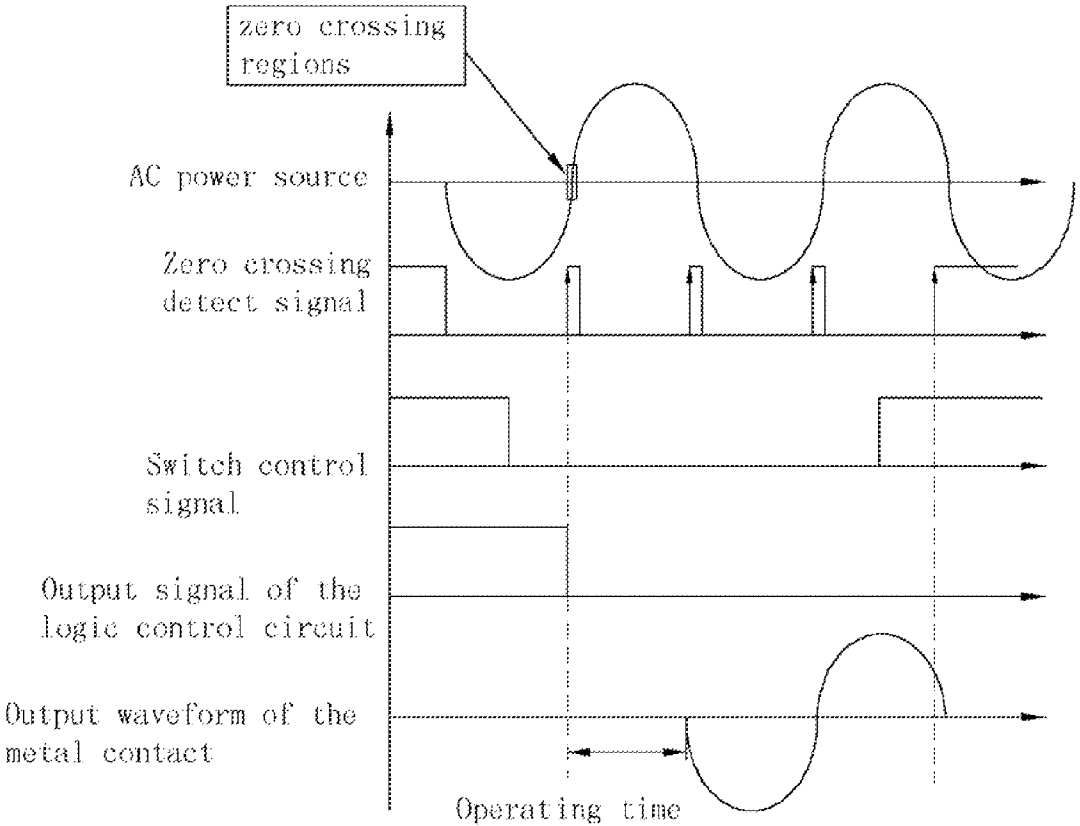
FIG. 3 is a graph illustrating an exemplary operation action of the relay as shown in FIG. 1.

Further referring to FIGS. 2-3, when the relay drive circuit 100 drives and controls the relay 200, the logic control circuit 30 receives the corresponding zero crossing detect signal and switch control signal and outputs different command signal according to the zero crossing detect signal and switch control signal. For example, when the zero crossing detect signal is high and the switch control signal is low, the logic control circuit 30 outputs a corresponding low command signal to the gate of the MOSFET Q2, accordingly the switch 40 is switched on. So the AC current from the drive power source 50 flows through the coil 210, resulting in the coil 210 generating a magnetic field and the metal contact 230 connecting the function circuits. When the zero crossing detect signal and the switch control signal are high, the logic control circuit 30 accordingly outputs a corresponding high command signal to the gate of the MOSFET Q2, the switch 40 then is switched off, so the metal contact 230 is disconnected from the function circuits.

Figure 4:
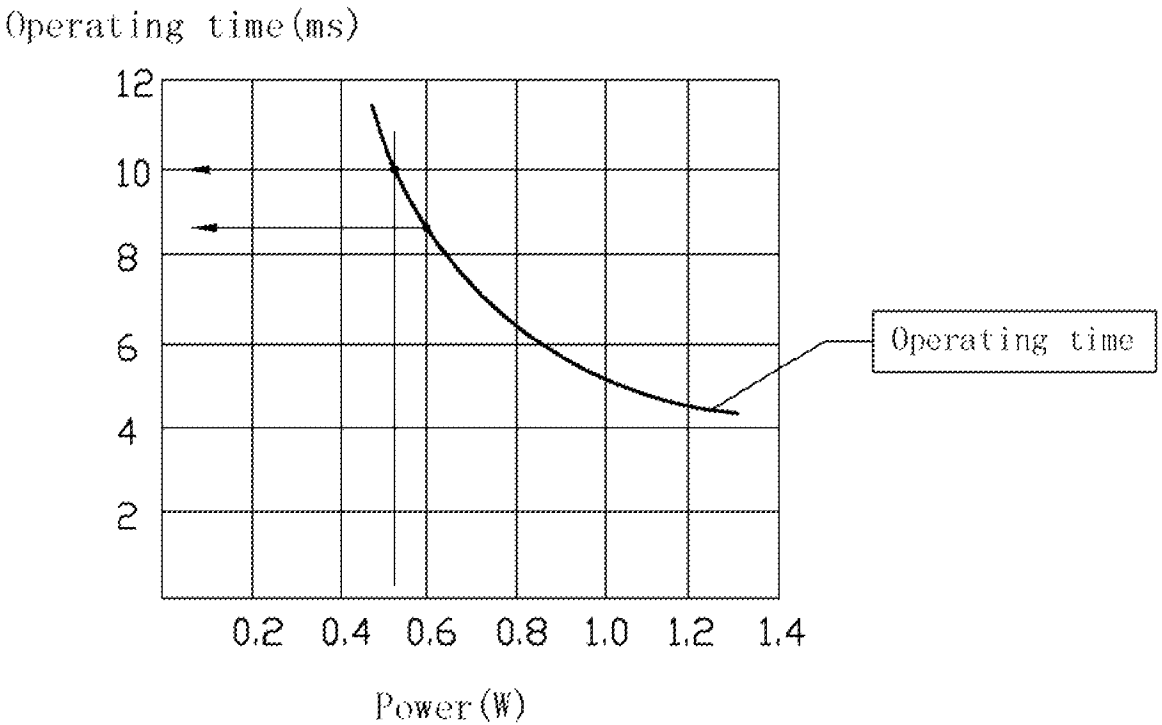
FIG. 4 is a graph illustrating an exemplary relationship between coil powers and corresponding operating times of switching a relay.

Further referring to FIG. 4, in the exemplary embodiment, the interval from the switch 40 turned on to the metal contact 230 connected to the function circuits can be defined as an operating time of the relay 200. To avoid the relay 200 generating electrical arcing when switching, the relay 200 can be powered on in the zero crossing regions, and the operating time of the relay 200 is substantially close to the half-cycle of the AC power source 300. In use, the frequency F of the AC power source 300 is substantially 50 Hz or 60 Hz, accordingly, the operating time T=½F=10 milliseconds (ms) or 8.3 ms.

As shown in FIG. 4, different powers of the coil 210 correspond to different operating times. The regulating circuit 60 is capable of adjusting the driving voltage of the relay 200 to make the operating time close to the half-cycle of the AC power source 300. In this embodiment, the power source 50 is a 12 volt direct current (DC) voltage source. Thus, the power of the coil 210 is accordingly changed by adjusting the divider resistances R61 and R62 and the resistance of the coil 210 to control the operating time. Moreover, the voltage of the coil 210 is also adjusted by connecting and disconnecting the jumper J1 to further adjust the operating time of the coil 210 to 10 ms or 8.3 ms.

The diode D2 can be a freewheeling diode (FWD). When the switch 40 is switched off, the coil 210 generates a corresponding self-induction voltage, so the FWD D2 is capable of releasing the self-induction voltage to avoid damaging other electronic components. Moreover, when the switch 40 is switched off, the gate of the MOSFET Q2 maintains a high voltage due to the second pull-up resistor R70 to make the switch 40 remain in an off state.

In the relay drive circuit 100 of the exemplary embodiment, the zero crossing test circuit 20 detects and obtains the corresponding zero crossing voltage points and zero crossing regions of the AC power source 300, the logic control circuit 30 controls and activates corresponding switch signals at the zero crossing regions. Thus, the switch 40 can power the relay 200 on/off timely at the zero crossing regions, resulting in avoiding generating electrical arcing and outputting unstable voltages when switching the relay 200 on/off.

It is to be understood, however, that even though numerous characteristics and advantages of the exemplary disclosure have been set forth in the foregoing description, together with details of the structure and function of the exemplary disclosure, the disclosure is illustrative only, and changes may be made in detail, especially in matters of shape, size, and arrangement of parts within the principles of exemplary disclosure to the full extent indicated by the broad general meaning of the terms in which the appended claims are expressed.

What is claimed is:

1. A relay drive circuit electrically connected to an alternating current power source for driving a relay, comprising:

a zero crossing test circuit that obtains zero crossing regions of the alternating current power source and outputs a zero crossing detect signal, the zero crossing test circuit comprising an optocoupler electrically connected to the alternating current power source and an output port electrically connected to the optocoupler, wherein when the alternating current power source is in the zero crossing regions, the optocoupler is turned off, and the output port outputs a corresponding high zero crossing detect signal to the logic control circuit;

a logic control circuit that receives the zero crossing detect signal and a corresponding switch control signal, the logic control circuit electrically connected to the zero crossing circuit; and a switch electrically connected the logic control circuit and the relay, wherein the switch is switched on or off in the zero crossing regions under the control of the output signal from the logic control circuit to correspondingly control the relay.

2. The relay drive circuit as claimed in claim 1, wherein the zero crossing test circuit comprises a current limiting resistance, the current limiting resistance being electrically connected to the optocoupler and the alternating current power source, and the current limiting resistance is capable of adjusting width of the zero crossing region.

3. The relay drive circuit as claimed in claim 2, wherein the optocoupler is an alternating current optocoupler.

4. The relay drive circuit as claimed in claim 1, wherein the switch is a p-channel metal-oxide semiconductor field effect transistor (MOSFET), and a drain of the MOSFET is electrically connected to ground, a gate of the MOSFET is electrically connected to the logic control circuit, and a source of the MOSFET is electrically connected to the relay.

5. The relay drive circuit as claimed in claim 1, wherein the switch is a pnp transistor, a base of the transistor is electrically connected to the logic control circuit, a collector of the transistor is electrically connected to ground, and an emitter of the transistor is electrically connected to the relay.

6. The relay drive circuit as claimed in claim 1, further comprising a drive power source, wherein the drive power source is electrically connected to the logic control circuit, the switch and the regulating circuit, and the drive power source is capable of providing a direct current driving voltage for the relay.

7. The relay drive circuit as claimed in claim 6, further comprising a regulating circuit, wherein the regulating circuit is electrically connected to the logic control circuit, the switch and the relay, and the regulating circuit is capable of adjusting the driving voltage of the relay to turn the relay on in the zero crossing region.

8. The relay drive circuit as claimed in claim 7, further comprising a freewheeling diode, wherein a cathode of the freewheeling diode is electrically connected to the regulating circuit, an anode of the freewheeling is electrically connected to the switch, and the freewheeling diode is capable of releasing self-induction voltage generated by the relay.

9. The relay drive circuit as claimed in claim 1, wherein when the zero crossing detect signal is high and the switch control signal is low, the logic control circuit outputs a corresponding low command signal to the switch, and the switch is turned on and the relay is powered on; when the zero crossing detect signal and the switch control signal are high, the logic control circuit outputs a corresponding high command signal to the switch, and the switch is turned off and the relay is powered off.

10. A relay drive circuit electrically connected to an alternating current power source, comprising:

a zero crossing test circuit that detects zero crossing points and obtains zero crossing regions of the alternating current power source and outputs a zero crossing detect signal, the zero crossing test circuit comprising an optocoupler electrically connected to the alternating current power source and an output port electrically connected to the optocoupler, wherein when the alternating current power source is in the zero crossing regions, the optocoupler is turned off, and the output port outputs a corresponding high zero crossing detect signal to the logic control circuit;

a logic control circuit that receives the zero crossing detect signal and a corresponding switch control signal, the logic control circuit electrically connected to the zero crossing circuit;

a drive power source that provides driving voltage for a relay, the drive power source electrically connected to the logic control circuit and the relay;

a switch electrically connected the logic control circuit and the relay, wherein the switch control signal has the same phase as output signal from the logic control circuit in the zero crossing regions, and the switch is switched on or off accordingly under the control of the output signal to correspondingly power the relay on or off.

11. The relay drive circuit as claimed in claim 10, wherein the zero crossing test circuit comprises a current limiting resistance, the current limiting resistance being electrically connected to the optocoupler and the alternating current power source, and the current limiting resistance is capable of adjusting width of the zero crossing region.

12. The relay drive circuit as claimed in claim 11, wherein the optocoupler is an alternating current optocoupler.

13. The relay drive circuit as claimed in claim 10, wherein the switch is a p-channel metal-oxide semiconductor field effect transistor (MOSFET), and a drain of the MOSFET is electrically connected to ground, a gate of the MOSFET is electrically connected to the logic control circuit, and a source of the MOSFET is electrically connected to the relay.

14. The relay drive circuit as claimed in claim 10, wherein the switch is a pnp transistor, a base of the transistor is electrically connected to the logic control circuit, a collector of the transistor is electrically connected to ground, and an emitter of the transistor is electrically connected to the relay.

15. The relay drive circuit as claimed in claim 10, further comprising a regulating circuit, wherein the regulating circuit is electrically connected to the logic control circuit, the switch and the relay, and the regulating circuit is capable of adjusting the driving voltage of the relay to turn the relay on in the zero crossing region.

16. The relay drive circuit as claimed in claim 15, wherein the regulating circuit comprises a first divider resistance, a second divider resistance electrically connected to the relay, and a jumper electrically connected to the first divider resistance and the second divider resistance, and the first divider resistance is electrically connected to the relay, the drive power source and the logic control circuit.

17. The relay drive circuit as claimed in claim 16, further comprising a freewheeling diode, a cathode of the freewheeling diode is electrically connected to the jumper and the first divider resistance, an anode of the freewheeling is electrically connected to the switch, and the freewheeling diode is capable of releasing self-induction voltage generated by the relay.

18. The relay drive circuit as claimed in claim 10, wherein when the zero crossing detect signal is high and the switch control signal is low, the logic control circuit outputs a corresponding low command signal to the switch, and the switch is turned on and the relay is powered on; when the zero crossing detect signal and the switch control signal are high, the logic control circuit outputs a corresponding high command signal to the switch, and the switch is turned off and the relay is powered off.

* * * * *